United States Patent [19]

Cortopassi

[11] 4,381,837

[45] May 3, 1983

[54] PROTECTIVE TRAY

[75] Inventor: Jeff J. Cortopassi, Santa Ana, Calif.

[73] Assignee: Container Corporation of America, Chicago, Ill.

[21] Appl. No.: 238,158

[22] Filed: Mar. 2, 1981

[51] Int. Cl.[3] ..... B65B 23/00; B65D 73/00

[52] U.S. Cl. ..... 206/485; 206/499; 206/560; 426/124; 426/106; 426/128

[58] Field of Search ..... 206/485, 560, 565, 497, 206/499; 426/124, 106, 128

[56] References Cited

U.S. PATENT DOCUMENTS

| | | | |
|---|---|---|---|
| 974,593 | 11/1910 | Perl | 206/485 |
| 2,306,624 | 12/1942 | Harris | 206/485 |
| 2,964,175 | 12/1960 | Nolte | 206/485 |
| 4,018,905 | 4/1977 | Adamek et al. | 206/485 |

*Primary Examiner*—Joseph Man-Fu Moy

*Attorney, Agent, or Firm*—Richard W. Carpenter; Davis Chin

[57] ABSTRACT

A paperboard tray for holding and protecting a plurality of fragile articles, such as taco shells, in a nested relationship.

3 Claims, 5 Drawing Figures

PROTECTIVE TRAY

BACKGROUND OF THE INVENTION

1. Field of the Invention

The invention relates generally to packages for fragile articles, and more particularly to a protective tray adapted to hold and cushion a plurality of fragile articles, such as taco shells, in a nested relation.

2. Description of the Prior Art

A state of the art search directed to the subject matter of this application uncovered the following U.S. Pat. Nos. 974,593; 2,306,624; 2,964,175; 3,507,668; and 4,018,905.

None of the prior art patents uncovered in the search disclosed a protective tray having all of the features of the present invention for supporting the packaged articles as hereinafter described in this application.

SUMMARY OF THE INVENTION

This invention relates to packages for fragile articles such as taco shells.

It is particular object of the invention to provide a carton for holding a plurality of taco shells in a nested relationship and which is adapted to be overwrapped with a sheet of plastic film.

A more specific object of the invention is to provide a paperboard tray having means in the bottom wall, the side walls and an end wall to engage and hole the packaged articles in spaced and cushioned relationship to protect them from damage.

These and other objects of the invention will be apparent from an examination of the following description and drawings.

THE DRAWINGS

It will be understood that, for purposes of clarity, certain elements may have been intentionally omitted from certain views, where they are believed to be illustrated to better advantage in other views.

DESCRIPTION OF THE INVENTION

Figure 1:
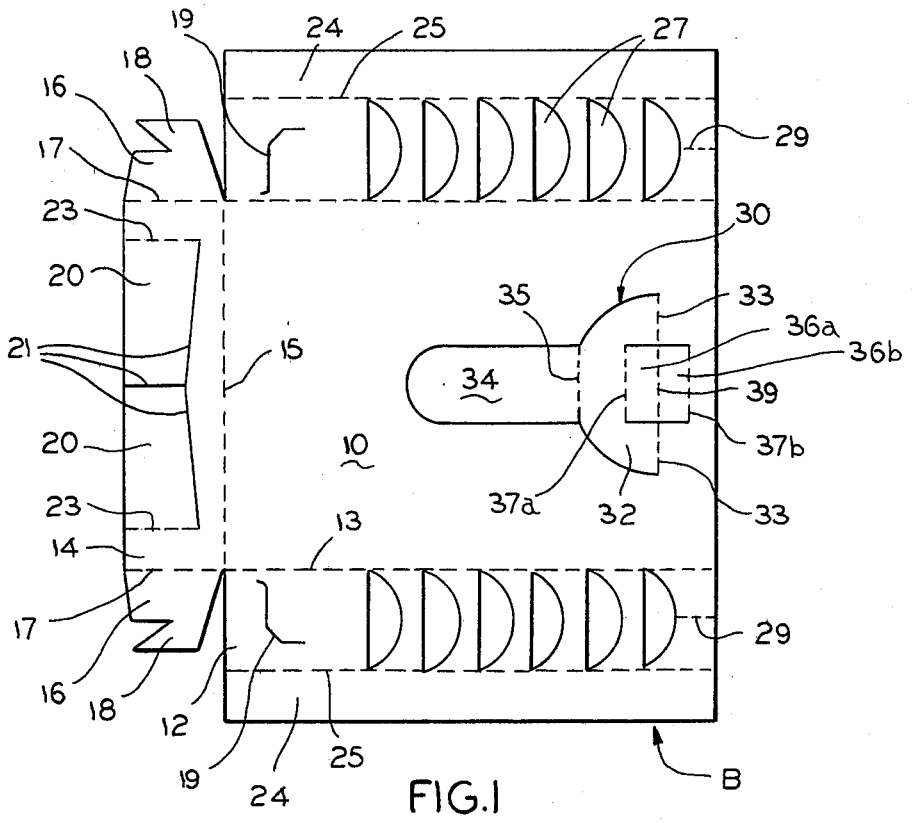
FIG. 1 is a plan view of a blank of foldable sheet material from which the carton or tray illustrated in the other views may be formed.
Figure 3:
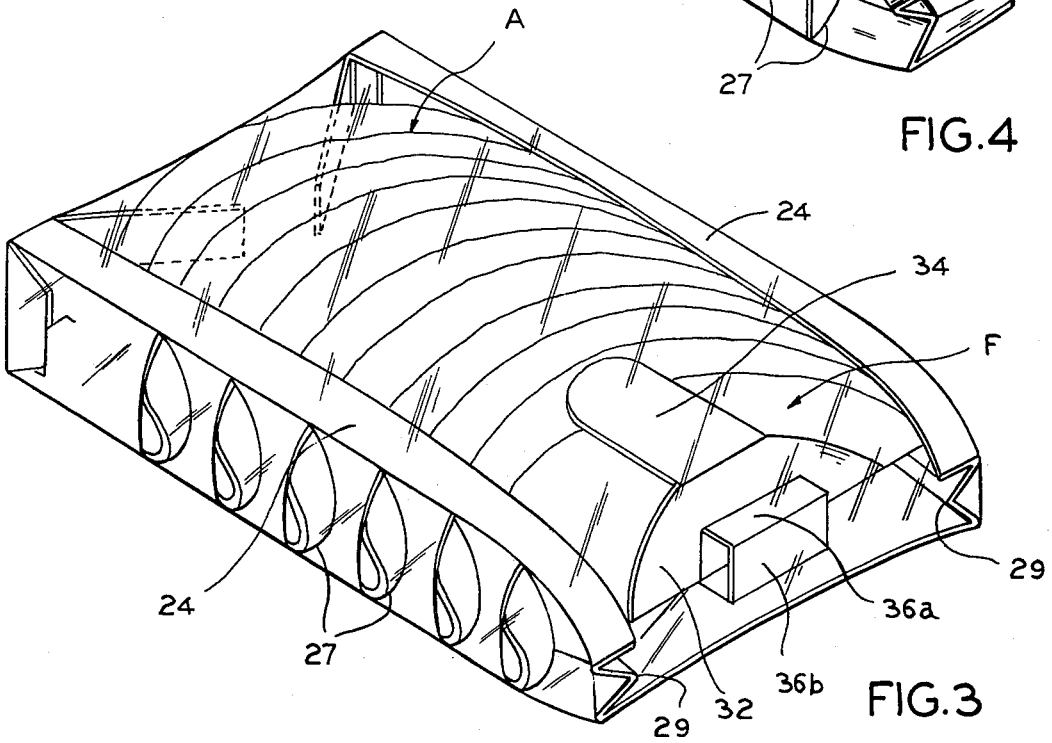
FIG. 3 is a view similar to FIG. 2, but showing the tray filled with a plurality of package articles and overwrapped with a sheet of film.
Figure 5:
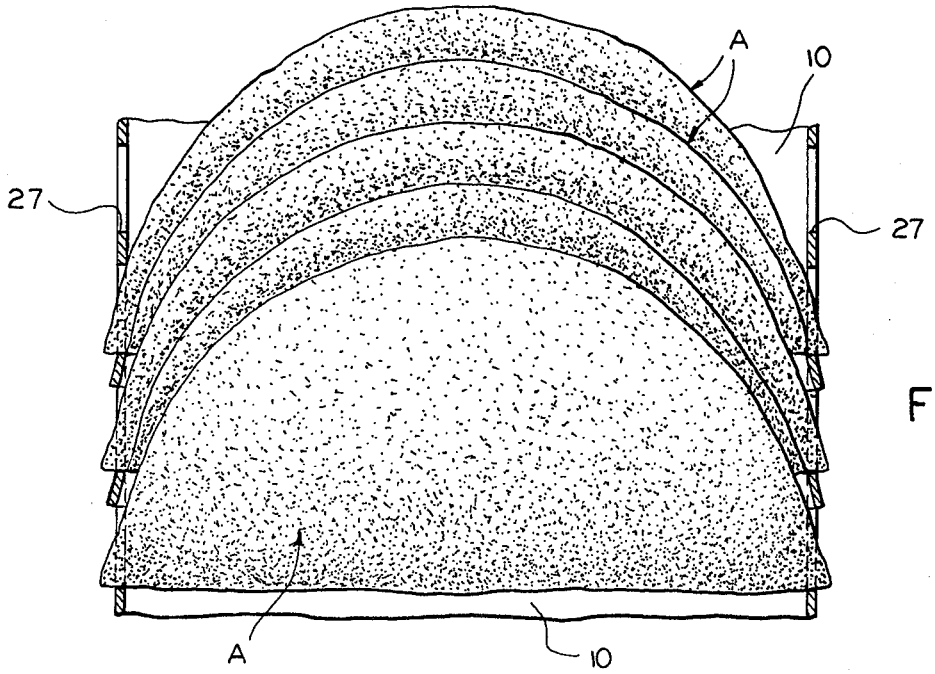
FIG. 5 is a top plan view, partially in section, of the structure illustrated in FIG. 3.

Referring now to the drawings for a better understanding of the invention, and particularly to FIGS. 3 and 5, it will be seen that the package includes a paperboard tray, indicated generally at T, which may be formed from a unitary blank B of foldable paperboard illustrated in FIG. 1. The package is designed to hold a plurality of fragile packaged articles, indicated generally at A, such as taco shells, which are arranged in a nested relationship within the tray T. The package is then adapted to be overwrapped with a plastic film F.

Figure 2:
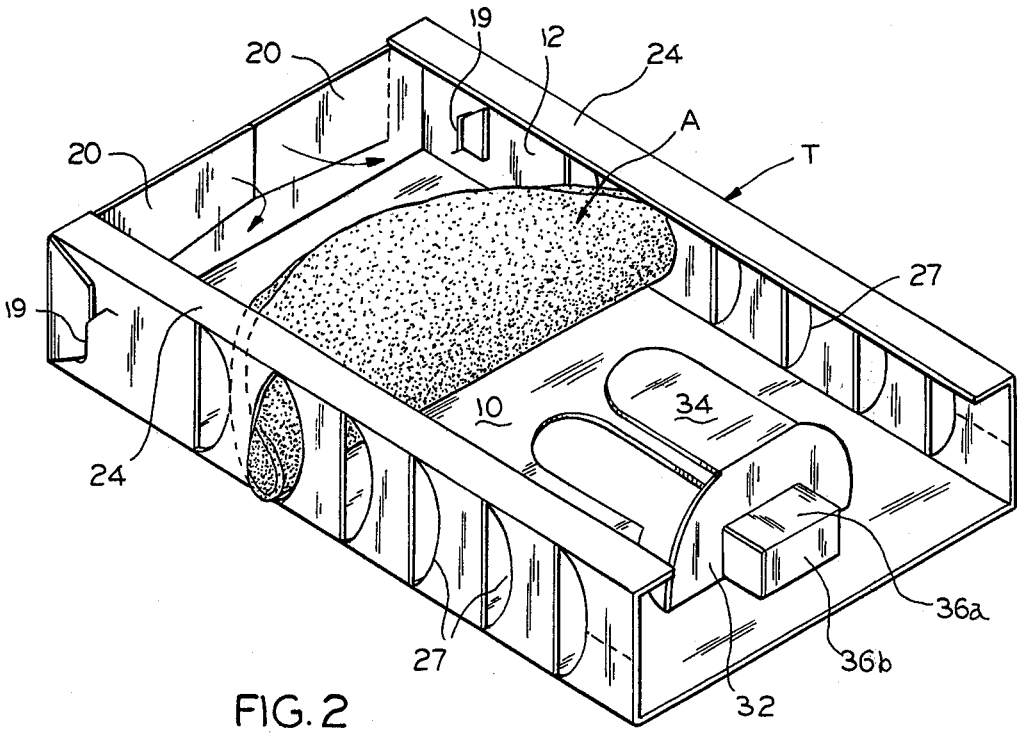
FIG. 2 is a perspective view of a tray embodying features of the invention and shown in the erected condition with one packaged article in place.

As best seen in FIGS. 1 and 2, tray T includes a generally rectangular bottom wall 10 having a pair of opposed side walls 12 foldably joined to opposed side edges thereof on fold lines 13 and disposed to extend upwardly therefrom. Tray T also includes an end wall 14 which is foldably joined on foldline 15 to an end edge of bottom wall 10 and which is disposed to extend upwardly therefrom. A pair of corner flaps 16 are foldably joined on foldlines 17 to opposed side edges of end wall 14. Each of the corner flaps 16 is provided with an outwardly projecting lock tab portion 18 which is adapted to be received within a complimentary locking slit 19 in the adjacent side wall of the carton to join the end and side walls to each other to form a tray-like structure.

End wall 14 includes a pair of integral support tabs 20 which are defined by cut lines 21 and which are foldably joined to end wall 14 along parallel spaced foldlines 23. The function of the support tabs is described later in the specification.

Still referring to FIGS. 1 and 2, it will be seen that a pair of shelf panels 24 are foldably joined to the upper edges of side walls 12 along parallel foldlines 25. Shelf panels 24 are folded inwardly so as to lie parallel to bottom wall 10.

It will be seen that each of the side walls is provided with a plurality of spaced recesses or openings 27 which are aligned with the corresponding recesses in the opposite side wall. The purpose of these recesses is to receive the ends of packaged articles to support them and maintain them in spaced relationship as best illustrated in FIGS. 2, 3, and 5.

Figure 4:
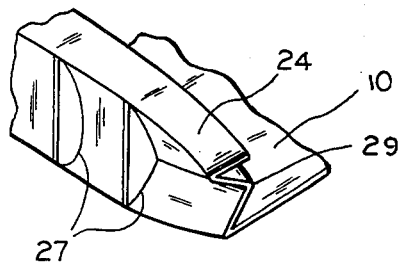
FIG. 4 is a fragmentary view of a portion of the structure of FIG. 3.

It will also be seen that each of the side walls 12 is provided at the opposite end of the tray from end wall 14 with a horizontal foldline 29. The purpose of this, as best seen in FIGS. 3 and 4, is to permit the ends of the tray to be compressed together slightly after the tray has been filled and before it is overwrapped with plastic film F.

Again referring to FIGS. 1 and 2, it will be seen that the tray is provided, adjacent the end opposite from end wall 14, with a cushion strap structure indicated generally at 30 which is formed from material cut from botton wall 10. Cushion strap 30 includes a vertical portion 32, which is foldably joined along a pair of spaced score lines 33 to bottom wall 10 and extending normally and upwardly therefrom, and a horizontal portion 34, foldably joined along foldline 35 to the upper edge of vertical portion 32, and entending toward end wall 14 in parallel relationship but spaced above bottom wall 10.

In order to provide a cushioning effect vertical portion 32 is also foldably joined to bottom wall 10 by a hinge member which includes a pair of first and second portions, 36*a* and 36*b* which are foldably joined to vertical portion 32 and bottom wall 10 on foldlines 37*a* and 37*b*, respectively, and which are foldably joined to each other on a reverse score 39 which is in alignment with scorelines 33.

The purpose of the cushion strap structure is to hold one end of the row of packaged articles in position and cushion them against some degree of shock if the package is dropped. The purpose of the end wall support tabs 20, which were previously referred to, is to support the other end of the package articles. As best seen in FIG. 3, support tabs 20 may be folded inwardly from the end wall to be received within portions of the endmost packaged articles to keep them in position and prevent them from being crushed. Thus, the entire package is of a relatively simple design and construction and yet affords excellent support and cushioning for a plurality of packaged articles such as fragile taco shells.

I claim:

1. A tray, formed from a unitary blank of foldable paperboard, for holding a plurality of packaged, fragile articles, such as taco shells, in a nested relationship, comprising:

(a) a bottom wall having an end wall and pair of side walls foldably joined to and upstanding from opposed end and side edges thereof to form a tray-like structure;

(b) a plurality of longitudinally spaced opending disposed in said side walls for receiving and retaining opposed end portions of said packaged articles in spaced relation;

(c) a pair of relatively narrow, elongated support panels hingedly attached to said end wall adjacent opposite ends thereof, said support panels foldable inwardly from the end wall to be received within portions of the end-most packaged articles to maintain them in position and to prevent them from being crushed; and (d) means foldable out of said bottom wall for supporting other portions of said packaged articles.

2. A tray according to claim 1, wherein said means of said bottom wall comprises: a cushion strap structure including:

(i) a vertical element foldably joined to and upstanding from said bottom wall;

(ii) a horizontal element foldably joined to an upper end of said vertical element and extending parallel to said bottom wall to define, with said vertical element and said bottom wall, a recess for receiving a packaged article.

3. A tray according to claim 2, wherein said cushion strap structure also includes a two-piece hinge member connecting said vertical element to said bottom wall.

* * * * *